US007726984B2

(12) United States Patent
Bumb, Jr. et al.

(10) Patent No.: US 7,726,984 B2
(45) Date of Patent: Jun. 1, 2010

(54) COMPLIANT INTERCONNECT APPARATUS WITH LAMINATE INTERPOSER STRUCTURE

(76) Inventors: Frank E. Bumb, Jr., 2246 E. Nicolet Ave., Phoenix, AZ (US) 85020; Nicholas Langston, Sr., 930 Liberty Ct., Cupertino, CA (US) 95014

( * ) Notice: Subject to any disclaimer, the term of this patent is extended or adjusted under 35 U.S.C. 154(b) by 18 days.

(21) Appl. No.: 11/958,560

(22) Filed: Dec. 18, 2007

(65) Prior Publication Data

US 2009/0156028 A1 Jun. 18, 2009

(51) Int. Cl.
*H01R 4/58* (2006.01)

(52) U.S. Cl. ..... 439/91; 439/591; 439/66

(58) Field of Classification Search ..... 439/66, 439/86, 91, 591
See application file for complete search history.

(56) References Cited

U.S. PATENT DOCUMENTS 5,759,047 A * 6/1998 Brodsky et al. ..... 439/66
6,027,346 A 2/2000 Sinsheimer et al.
6,341,962 B1 * 1/2002 Sinclair ..... 439/66
6,471,525 B1 10/2002 Fan et al.
6,524,115 B1 * 2/2003 Gates et al. ..... 439/66
6,574,114 B1 6/2003 Brindle et al.
7,004,762 B2 2/2006 Okitsu
2004/0087189 A1 * 5/2004 Grant et al. ..... 439/66

* cited by examiner

*Primary Examiner*—Tho D Ta
*Assistant Examiner*—Travis Chambers
(74) *Attorney, Agent, or Firm*—Parsons & Goltry; Michael W. Goltry; Roberts A. Parsons

(57) ABSTRACT

Apparatus to electrically connect a first electrical contact to a second electrical contact includes opposed upper and lower elastomer layers formed on either side of an electrically insulating intermediate layer together forming a laminate interposer structure having a thickness. An electrically conducting elastic column to provide a localized conductive path is formed through the thickness of the laminate interposer structure. The upper and lower elastomer layers provide compliance between the upper and lower elastomer layers and the elastic column, and the intermediate layer provides reduced compliance between the intermediate layer and the elastic column relative to the compliance between the upper and lower elastomer layers and the elastic column.

8 Claims, 5 Drawing Sheets

COMPLIANT INTERCONNECT APPARATUS WITH LAMINATE INTERPOSER STRUCTURE

FIELD OF THE INVENTION

The invention relates to systems and methods for electrically connecting electrical contacts of opposed electrical devices for test and evaluation purposes.

BACKGROUND OF THE INVENTION

The introduction of solid-state semiconductor electronics provided the opportunity for progressive miniaturization of components and devices. One of the benefits of such miniaturization is the capability of packing more components into a given space, which increases the features, versatility and functionality of an electronic device, and usually at lower cost. A drawback of such advances is the reduction in spacing between contacts on one device and the need for accurate alignment with corresponding contacts on a second device to provide reliable electrical interconnection there between. Modern technology, using VLSI electronics, challenges design engineers to provide such fine interconnection structures that electrical isolation between individual connectors becomes a primary concern. Secondary to connector isolation is the reduction in pliability of insulating material between electrical contacts as the distance between contacts decreases. Thus, a geometrical array of contacts held together by a planar insulating material allows less independent movement between contacts the closer they approach each other. Absent freedom of movement, individual contacts may fail to connect to a target device, especially if some of the device contacts lie outside of a uniform plane. Lack of planarity causes variation in the distance between the device contacts and an array of contacts intended to mate with the device contacts. Accurate engagement by some contacts leaves gaps between other contacts unless independent contacts have freedom to move across such gaps. Alternatively the connecting force between an array of contacts and device contacts must be increased for reliable interconnection with resulting compression and potential damage for some of the contacts.

Interconnection of electronic components with finer and finer contact spacing or pitch has been addressed in numerous ways in the prior art along with advancements in semiconductor device design. Introduction of ball grid array (BGA) devices placed emphasis on the need to provide connector elements with space between individual contacts at a minimum. One answer, found in U.S. Pat. Nos. 5,109,596 and 5,228,189, describes a device for electrically connecting contact points of a test specimen, such as a circuit board, to the electrical contact points of a testing device using an adapter board having a plurality of contacts arranged on each side thereof. Cushion-like plugs made from an electrically conductive resilient material are provided on each of the contact points to equalize the height variations of the contact points of the test specimen. An adapter board is also provided made of a film-like material having inherent flexibility to equalize the height variations of the contact points of the test specimen. Furthermore, an adapter board is provided for cooperating with a grid made of an electrically insulated resilient material and having a plurality of plugs made from an electrically conductive resilient material extending therethrough. Successful use of this device requires accurate registration of contacts from the test specimen, through the three layers of planar connecting elements to the testing device.

U.S. Pat. Nos. 5,136,359 and 5,188,702 disclose both an article and a process for producing the article as an anisotropic conductive film comprising an insulating film having fine through-holes independently piercing the film in the thickness direction, each of the through-holes being filled with a metallic substance in such a manner that at least one end of each through-hole has a bump-like projection of the metallic substance having a bottom area larger than the opening of the through-hole. The metallic substance serving as a conducting path is prevented from falling off, and sufficient conductivity can be thus assured. While the bump-like projections of the anisotropic conductive films, previously described, represent generally rigid contacts, U.S. Pat. Nos. 4,571,542 and 5,672,978 describe the use of superposed elastic sheets over a printed wiring board, to be tested, and thereafter applying pressure to produce electroconductive portions in the elastic sheet corresponding to the contact pattern on the wiring board under test. In another example of a resilient anisotropic electroconductive sheet, U.S. Pat. No. 4,209,481 describes a non-electroconductive elastomer with patterned groupings of wires, electrically insulated from each other, providing conductive pathways through the thickness of the elastomer. Other known forms of interconnect structure may be reviewed by reference to United States Patents including U.S. Pat. Nos. 5,599,193, 5,600,099, 5,049,085, 5,876,215, 5,890,915 and related patents.

In addition to the problem, mentioned previously, of interconnection failure caused by gaps between contacts, an additional cause of interconnection failure occurs by occlusion of a metal contact due to surface contamination with, as a matter of example, grease, non-conducting particles, or a layer of metal oxide. Such an oxide layer results from air oxidation of the metal. Since oxide layers generally impede the passage of electrical current, reliable contact requires removal or penetration of the oxide layer as part of the interconnection process. Several means for oxide layer penetration, towards reliable electrical connection, may be referred to as particle interconnect methods as provided in U.S. Pat. Nos. 5,083,697, 5,430,614, 5,835,359 and related patents. A commercial interconnect product, described as a Metalized Particle Interconnect or MPI, is available from Thomas & Betts Corporation. The product is a high temperature, flexible, conductive polymeric interconnect which incorporates piercing and indenting particles to facilitate penetration of oxides on mating surfaces. Another commercial, electronic device interconnection product, available from Tecknit of Cranford, N.J., uses "Hard Hat" and "Fuzz Button" contacts in selected arrays. U.S. Pat. Nos. 4,574,331, 4,581,679 and 5,007,841 also refer to the "Fuzz Button" type of contact.

The previous discussion shows that interconnection of electronic devices has been an area subject to multiple concepts and much product development in response to the challenges associated with mechanical issues of interconnection and resultant electrical measurements. Regardless of advancements made, there is continuing need in the art for improved registration between interconnecting devices and electronic components, and increased operating life of interconnect assemblies, which are expensive and presently perishable over a relatively modest operating life. In view of the continuing needs, associated with interconnect structures, the present invention has been developed to alleviate drawbacks and provide the benefits described below in further detail.

SUMMARY OF THE INVENTION

The present invention provides a compliant interconnect assembly, including a laminate interposer structure, for effecting reliable electrical connection between electronic devices, which has an exceptionally improved operating life, which is inexpensive, and which is easy to construct.

According to the principle of the invention, apparatus to electrically connect a first electrical contact to a second electrical contact includes opposed upper and lower elastomer layers formed on either side of an intermediate layer together forming a laminate interposer structure having a thickness, an electrically conducting elastic column to provide a localized conductive path through the thickness of the laminate interposer structure, the upper and lower elastomer layers to provide compliance between the upper and lower elastomer layers and the elastic column, and the intermediate layer to provide inhibited compliance between the intermediate layer and the elastic column relative to the compliance between the upper and lower elastomer layers and the elastic column. The intermediate layer comprises a sheet of material substantially rigid along a plane substantially perpendicular relative to the elastic column. The elastic column has an elongate shape disposed along a longitudinal axis substantially perpendicular relative to the laminate interposer structure, including the plane. The sheet is formed with an inwardly-directed continuous edge confronting and encircling an intermediate portion of the elastic column between the opposed upper and lower ends of the elastic column. In one embodiment, the inwardly-directed continuous edge contacts the elastic column. In another embodiment, the inwardly-directed continuous edge is spaced away from the elastic column. In the latter embodiment, there is a void encircling and formed between the inwardly-directed continuous edge and the elastic column, the sheet of material is electrically conductive, and the elastic column electrically contacts the inwardly-directed continuous edge in response to compression of the elastic column.

In accordance with the principle of the invention, apparatus to electrically connect a first electrical contact to a second electrical contact includes opposed upper and lower elastomer layers having opposed inner and outer faces, the inner faces of the opposed upper and lower elastomer layers formed on either side of an intermediate layer together forming a laminate interposer structure having a thickness, an electrically conducting elastic column to provide a localized conductive path through the thickness of the laminate interposer structure between the outer faces of the opposed upper and lower elastomer layers, the upper and lower elastomer layers to provide compliance between the upper and lower elastomer layers and the elastic column, the intermediate layer to provide inhibited compliance between the intermediate layer and the elastic column relative to the compliance between the upper and lower elastomer layers and the elastic column, and a spacer, to regulate compression against the elastic column, positioned in juxtaposition relative to the outer face of one of the upper and lower elastomer layers. The intermediate layer consists of a sheet of material substantially rigid along a plane substantially perpendicular relative to the elastic column. The elastic column has an elongate shape disposed along a longitudinal axis substantially perpendicular relative to the laminate interposer structure, including the plane. The sheet is formed with an inwardly-directed continuous edge confronting and encircling an intermediate portion of the elastic column between the opposed upper and lower ends of the elastic column. In one embodiment, the inwardly-directed continuous edge contacts the elastic column. In another embodiment, the inwardly-directed continuous edge is spaced away from the elastic column. In the latter embodiment, there is a void encircling and formed between the inwardly-directed continuous edge and the elastic column, the sheet of material is electrically conductive, and the elastic column electrically contacts the inwardly-directed continuous edge in response to compression of the elastic column.

BRIEF DESCRIPTION OF THE DRAWINGS

Referring to the drawings.

DETAILED DESCRIPTION OF PREFERRED EMBODIMENTS

Figure 1:
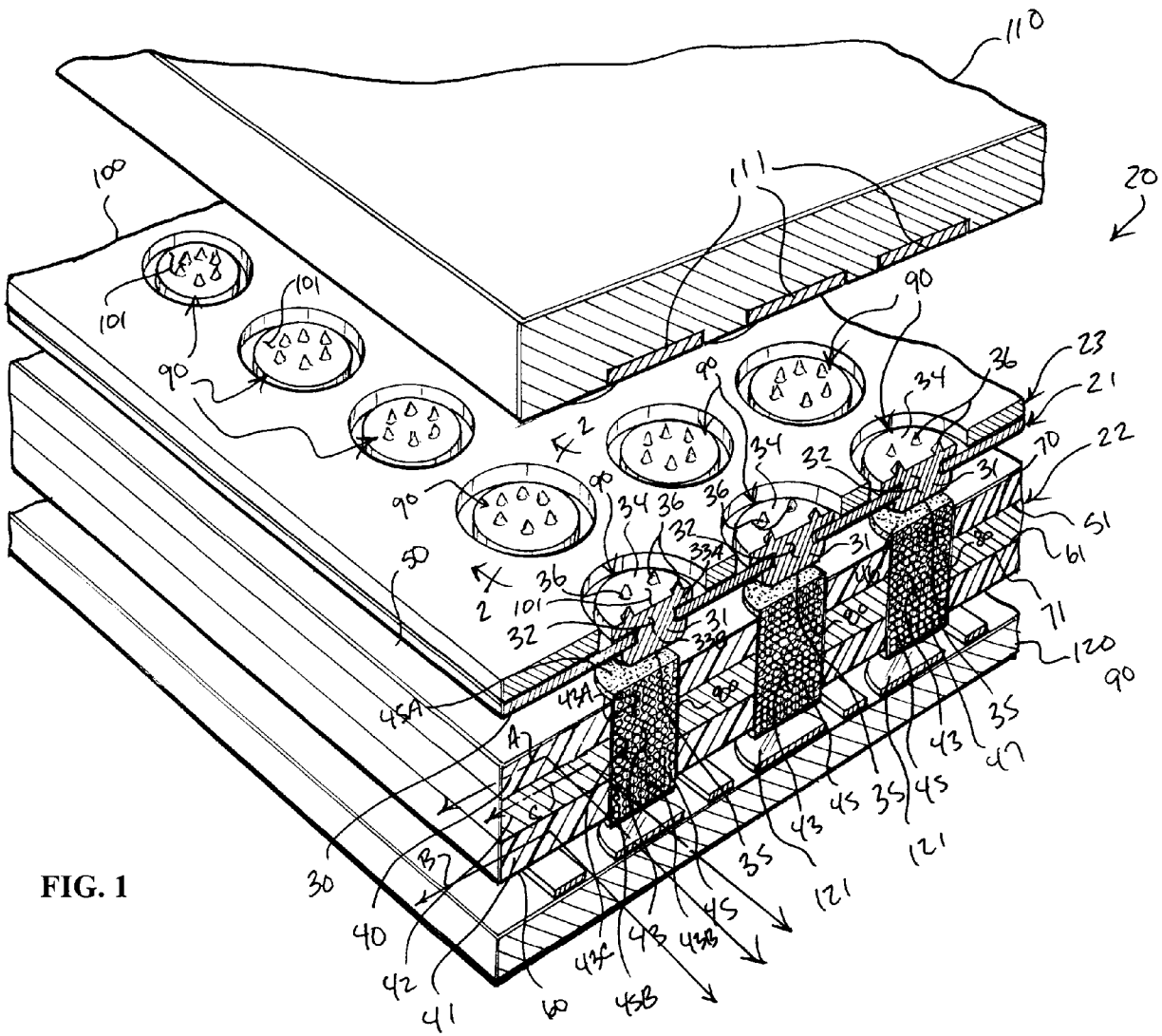
FIG. 1 is a fragmented perspective view of a compliant interconnect apparatus, with a laminate interposer structure, constructed and arranged in accordance with the principle of the invention.

Turning now to the drawings, in which like reference characters indicate corresponding elements throughout the several views, attention is first directed to FIG. 1 in which there is seen a fragmented perspective view of a compliant interconnect apparatus 20 constructed and arranged in accordance with the principle of the invention including contact set 21, and a laminate interposer structure 22. In the embodiment depicted in FIG. 1, a spacer 23 is also provided in conjunction with compliant interconnect apparatus 20. Contact set 21 includes a flexible film or sheet 30, having a thickness, formed with conductive contacts 31 received and suspended in receiving areas or holes 32 formed through the thickness of the sheet 30. Sheet 30 is formed of electrically-insulating, or electrically non-conductive material, thereby electrically isolating conductive contacts 31 relative to each other. In a particular example, sheet 30 is formed of polyimide material, such as the type found under the trademark Kapton, and has a preferred thickness of approximately 0.05 mm (0.002 inch). The patterns of conductive contacts 31 in contact set 21 may take any form depending on the corresponding contact patterns on electronic devices to be electrically interconnected, and this is well within the understanding and skill attributed to the skilled artisan. Conductive contacts 31 are substantially rigid, non-compliant contacts held in holes 32 formed in sheet 30 such that a head 33A and an opposed tail 33B of each conductive contact 31 overlaps the upper and lower edges of holes 32, protrude on the upper and lower sides of sheet 30, respectively, and have an upper contact surface 34 formed in head 33A and an opposed lower contact surface 35 formed in tail 33B.

With additional regard to FIG. 2, upper contact surface 34 preferably possesses coplanarity in a plane above the flat, flexible sheet 30 with a similar coplanar relationship of lower contact surfaces 35 in a plane below sheet 30. Upper contact surface 34 of each conductive contact 31 includes pointed asperities 36. Asperities 36 are sharp tipped barbs of suitable hardness to penetrate any oxide coating present at the surface of contacts that may be engaged, for electrical interconnection, by the contact set 21. Asperities 36 preferably have a height of about 0.05 mm (0.002 inch) and a tip diameter of less than 0.025 mm (0.001 inch) at the sharpest point, and other suitable dimensions can be utilized as may be desired depending on the specific application. While head 33A of each conductive contact 31 above sheet 30 has contact surface 34, formed with asperities 36, constructed for optimum contact with an electronic device, tail 33B of each conductive contact 31 formed below sheet 30 focuses contact force at the interface between contact surface 35 and the corresponding contact surface of electrically conducting elastic columns formed in laminate interposer structure 22.

The process of forming contact set 21 uses multiple steps according to common practices for forming and plating printed circuit features, the details of which are notoriously well-known in the art and will not be discussed.

According to the principle of the invention, laminate interposer structure 22, as illustrated in FIG. 1, consists of opposed upper and lower elastomer films or layers 40 and 41 formed on either side of an intermediate film or layer 42 together forming laminate interposer structure 22 having a thickness. Bores, vias, or holes 43 are formed, such as by drilling, in a pattern through the thickness of laminate interposer structure 22. Electrically conducting elastic columns 45 are formed in holes 43 through the thickness of laminate interposer structure. Referencing also FIG. 2, each elastic column 45 juts out slightly beyond the opposite upper and lower surfaces or faces of laminate interposer structure 22. The pattern of holes 43 formed in laminate interposer structure 22 defines the corresponding pattern of elastic columns 45 and relates to the pattern of conductive contacts 31 in contact set 21.

Each elastic column 45 provides a localized conductive path through the thickness of the laminate interposer structure 22. Upper and lower elastomer layers 40 and 41 provide compliance between upper and lower elastomer layers 40 and 41 and each of the elastic column 45 on either side of intermediate layer 42, in accordance with the principle of the invention. According to the principle of the invention, intermediate layer 42 provides rigidity or otherwise inhibited compliance between intermediate layer 42 and elastic columns 45 relative to the compliance between the upper and lower elastomer layers 40 and 41 and the elastic columns 45.

Elastomer layers 40 and 41 are formed of silicone elastomer or other selected elastomer material, and are of substantially uniform thickness. Elastomer layer 40 resides in and is compliant along an x-y plane A, and elastomer layer 41 resides in and is compliant along an x-y plane B. Planes A and B are coplanar, and are substantially perpendicular relative to elastic columns 45. Intermediate layer 42 is a sheet of material, which is substantially rigid along an x-y plane C coplanar relative to the upper and lower elastomer layers 40 and 41 including x-y planes A and B, and substantially perpendicular relative to elastic columns 45. Elastic columns 45 are substantially uniform in size, each having an elongate shape disposed along a longitudinal axis substantially perpendicular relative to the laminate interposer structure, including elastomer layers 40 and 41 and intermediate layer 42 and also planes A, B, and C.

Elastomer layer 40 has a thickness and opposed, parallel outer and inner faces or surfaces 50 and 51, elastomer layer 41 has a thickness and opposed, parallel outer and inner faces or surfaces 60 and 61, and intermediate layer 42 has a thickness and opposed, parallel upper and lower faces or surfaces 70 and 71. Elastomer layers 40 and 41 are formed, such as by molding, onto upper and lower surfaces 70 and 71, respectively, of intermediate layer 42. Inner surface 51 of elastomer layer 40 is applied to upper surface 70 of intermediate layer, and inner surface 61 of elastomer layer 41 is applied to lower surface 71 of intermediate layer 42. Holes 43 extend through the thickness of laminate interposer from outer surface 50 of elastomer layer 40 to outer surface 60 of elastomer layer 41. Holes 43 each have an inner diameter, which is substantially constant from outer surface 50 of elastomer layer 40 to outer surface 60 of elastomer layer 41. Holes 43 each form a hole 43A through elastomer layer 40, a hole 43B through elastomer layer 41, and a hole 43C through intermediate layer 42. Holes 43A-43C are substantially equal in size and inner diameter and are coaxial.

Elastic columns 45 each have an outer diameter formed in the inner diameter of a corresponding hole 43 between outer surfaces 50 and 60 of elastomer layers 40 and 41 of laminate interposer structure 22, and jut out slightly beyond the opposite outer surfaces 50 and 60 of elastomer layers 40 and 41 of laminate interposer structure 22. The ends of elastic columns 45 jutting out slightly beyond outer surface 50 of elastic column 40 are upper ends 45A of the elastic columns 45, and the ends of elastic columns 45 jutting out slightly beyond outer surface 60 of elastomer layer 41 are lower ends 45B of the elastic columns 45. Upper and lower ends 45A and 45B of each elastic column 45 form opposed upper and lower contact surfaces 46 and 47 of each elastic column 45. Each hole 43C formed through intermediate layer 42 is bound and defined by an inwardly-directed continuous edge 80 formed in intermediate layer 42, which confronts, encircles, and contacts an intermediate portion or thickness of the outer diameter of the corresponding elastic column 45 between the opposed upper and lower ends 45A and 45B thereof and, moreover, between elastomer layers 40 and 41.

To form holes 43, two spacer layers of protective tape are applied to outer surfaces 50 and 51, respectively, of elastomer layers 40 and 41. A drilling sequence is carried out forming the pattern of holes 43 through the thickness of laminate interposer structure 22, which pattern of holes 43 relates to the pattern of conductive contacts 31 of contact set 21 or, for instance, the conductive contacts of the electronic device to be interconnected or tested. Fluid conductive silicone is applied to each hole 43, which is left to cure to form elastic columns 45 in holes 43. A typical conductive silicone fluid is used, which consists of a curable silicone composition containing conductive particles, such as particulate metals such as copper, nickel, silver coated metals, and conductive carbon particulates and the like. After curing of the conductive silicone forming the elastic columns 45, excess conductive silicone is removed by, for instance, shaving away the excess conductive silicone. A spacer layer of protective tape is removed from each of the outer surfaces 50 and 51 of elastomer layers 40 and 41, which reveal tips of the electrically conductive elastic columns, which are sized according to the column diameters and thickness of the spacer layers of protective tape. The possibility that some of the column or ends tips may have contact surface irregularities can require the need for a second shaving step, against the smooth surface of second spacer layers applied to outer surfaces 50 and 60, respectively, of elastomer layers 40 and 41, until there is coplanarity of the surface of each of the spacer layers with the tips of the elastic columns 45 forming the opposed upper and lower contact surfaces of the elastic columns 45 having exposed particles. After removing the remaining spacer layers of protective tape from outer surfaces 50 and 60 of elastomer layers 40 and 41, rows of compliant projections having exposed particles at upper and lower contact surfaces thereof appear at outer surfaces 50 and 60 of elastomer layers 40 and 41, this time with essentially uniform coplanar contact surfaces, comprising contact surfaces 46 and 47 in upper and lower ends 45A and 45B of elastic columns 45, to allow reliable contact between electronic devices via electrically conducting elastic columns. Before use, the formed laminate interposer structure 22 requires cleaning to remove surface contamination and debris. Thus formed, laminate interposer structure 22 has attributes including precise construction, flexibility, high resilience, high durability, and low profile.

Spacer 23 includes a sheet 100, having a thickness, formed with holes 101. Holes 101 are formed in a pattern that relates to the pattern of conductive contacts 31 of contact set 21, and that also relates to the pattern of elastic columns 45 formed in laminate interposer structure 22. Spacer 23 is superimposed atop and rests against contact set 21, and is positioned such that heads 33A of conductive contacts 31 supporting asperities 36 protruding from the upper side sheet 30 are received in holes 101 and asperities 36 extend somewhat upwardly relative to the upper side of sheet 100 as illustrated in FIG. 2. Sheet 100 is formed of electrically-insulating, or electrically non-conductive, material. Preferably sheet 100 is formed of polyimide material, such as the type found under the trademark Kapton.

Laminate interposer structure 22 and each elastic column 45 and the corresponding conductive contact 31 of contact set 21 constitutes a compliant interconnect assembly of compliant interconnect apparatus 20, in which each such compliant interconnect assembly is denoted generally with the reference character 90. For reference purposes as denoted in FIG. 2, the inner diameter of hole 43 is denoted at D1, and the outer diameter of elastic column 45 is denoted at D2.

Compliant interconnect apparatus 20 provides low contact force interconnection between electronic devices, which, in FIG. 1, include an electronic device 110 formed with planar electrical contacts 111 of a planar contact grid array (PCGA), and a load or test board 120. Connection points on the load or test board 120 take the form of planar electrical contacts 121. Interconnection of device 110 to board 120 utilizes compliant interconnect apparatus 20 according to the present invention. Contact set 21 makes contact between contacts 111 of device 110 and the upper contact faces 46 formed in upper ends 45A of elastic columns 45 of laminate interposer structure 22, and the lower contact faces 47 formed in lower ends 45B of elastic columns 45 of laminate interposer structure 22 make contact with contacts 121 of board 120. Because compliant interconnect assemblies 90 are identical, the ensuing discussion of the operation of one compliant interconnect assembly 90 interconnecting a contact 110 of device 110 to a corresponding contact 121 of board 120 applies equally to each compliant interconnect assembly 90. As a matter of illustration, FIG. 2 is a sectional view taken along line 2-2 of FIG. 1 illustrating a compliant interconnect assembly 90 of compliant interconnect apparatus 20 shown as it would appear at rest or otherwise in a resting state, and FIG. 3 is a sectional very similar to that of FIG. 2 illustrating the compliant interconnect assembly 90 of compliant interconnect apparatus 90 shown as it would appear actuated or otherwise in an actuated state electrically interconnecting contact 111 of device 110 to contact 121 of board 120.

Figure 2:
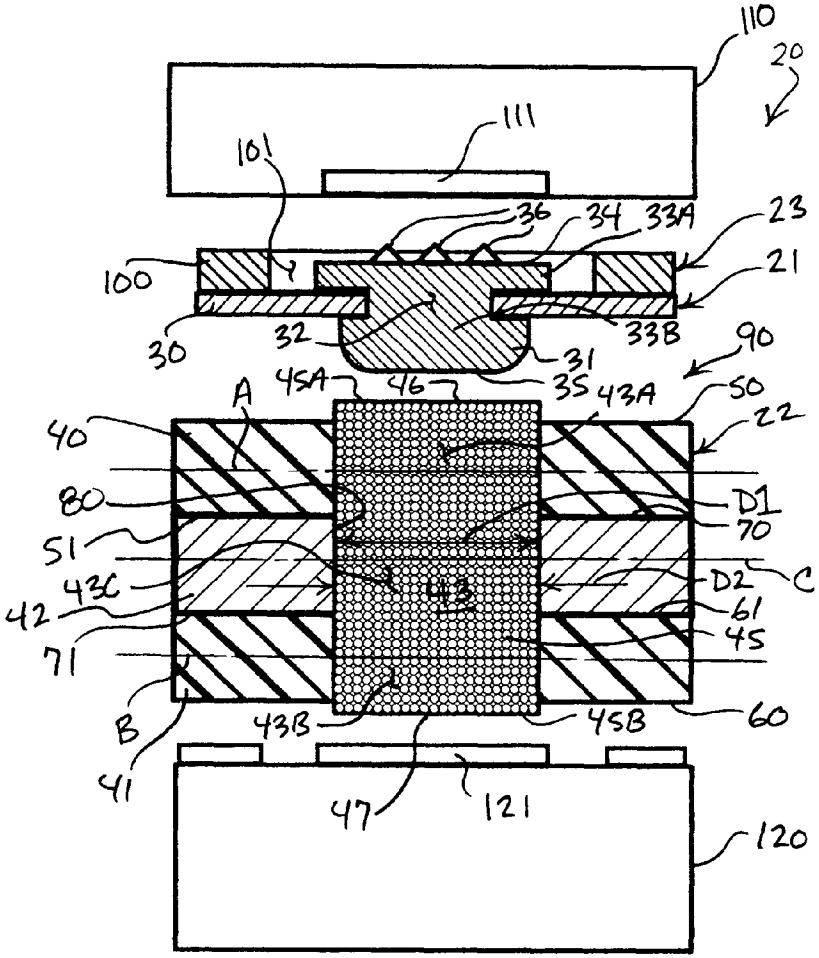
FIG. 2 is a sectional view taken along line 2-2 of FIG. 1 illustrating a compliant interconnect assembly of the compliant interconnect apparatus of FIG. 1, the compliant interconnect assembly shown in a resting state.

In FIG. 2, device 110 is positioned atop spacer 23 located atop contact set 21 that is in turn located atop laminate interposer structure 22 overlying board 120. Spacer 23 is superimposed atop and rests against the upper side of contact set 21, and is positioned such that head 33A of conductive contact 31 supporting asperities 36 protruding from the upper side sheet 30 is received in hole 101 as illustrated, and asperities 36 extend somewhat upwardly relative to the upper side of spacer 23 confronting device 110 as clearly illustrated. Contact 111 of device 110 opposes, is registered with, and is spaced from asperities 36 formed in contact surface 34. Contact set 21 is, in turn, superimposed atop laminate interposer structure 22, whereby contact surface 35 of tail 33B of conductive contact 31 opposes, is registered with, and is spaced from contact surface 46 formed in upper end 45A of elastic column 45. Laminate interposer structure 22 is, in turn, superimposed atop board 120, whereby contact surface 47 formed in lower end 45B of elastic column 45 opposes, is registered with, and is spaced from contact 121 of board 120.

Figure 3:
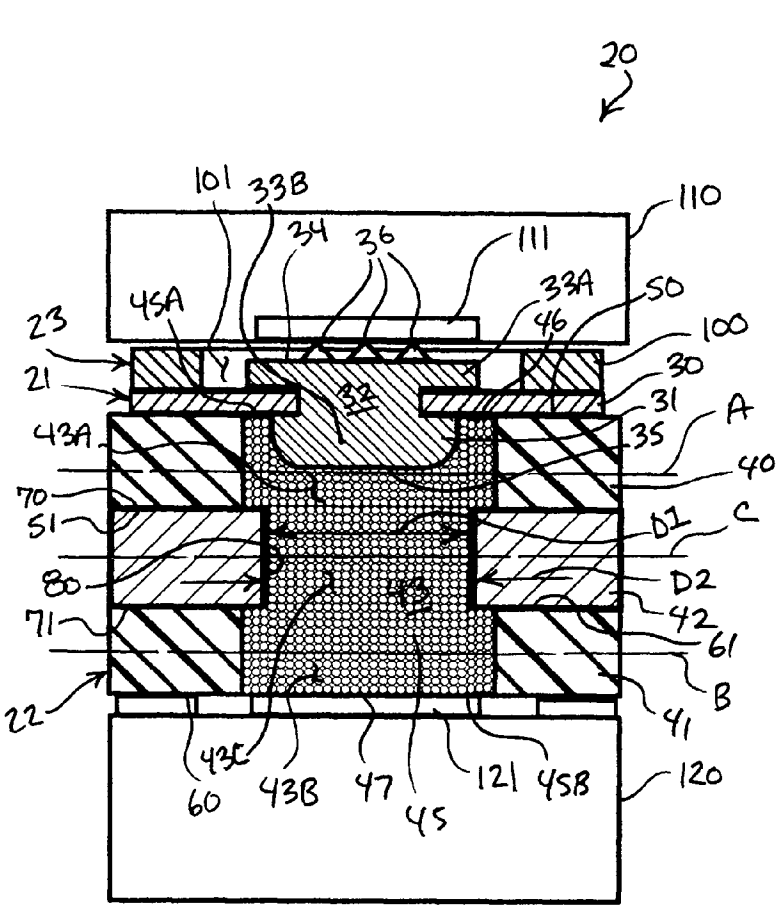
FIG. 3 is a view very similar to that of FIG. 3 illustrating the compliant interconnect assembly shown in an actuated state.

To form the interconnection between contacts 111 and 121 as illustrated in FIG. 3, an actuation is carried out. To carry out an actuation, device 110, spacer 23, contact set 21, laminate interposer structure 22, and board 120 are initially brought together, in which contact 111 of device 110 makes electrical contact with asperities 36 formed in contact surface 34 of conductive contact 31, contact surface 35 formed in tail 33B of conductive contact 31 makes electrical contact with contact surface 46 formed in upper end 45A of elastic column 45, and contact surface 47 formed in lower end 45B of elastic column 45 makes electrical contact with contact 121 of board 120. Asperities 36 formed in contact surface 34 of conductive contact 31 extending upwardly toward contact 111 relative to the upper side of spacer 23 make reliable contact with contact 111 penetrating or abrading or otherwise disrupting any oxide covering that may have formed on contact 111.

At this point, compression is applied between device 110 and board 120 to complete the actuation compressing compliant interconnect assembly 90 therebetween driving tail 33B into upper end 45A of elastic column 45 compressing elastic column 45 along the z-axis or longitudinal axis of elastic column 45 at upper and lower ends 45A and 45B thereof between contact surface 35 of conductive contact 31 and contact 121 of board 120. In response to this z-axis compressing of elastic column 45 at contact surfaces 46 and 47 at upper and lower ends 45A and 45B thereof between contact surface 35 formed in tail 33B of conductive contact 31 and contact 121 of board 120, compliant interconnect assembly 90 is actuated or otherwise disposed in the actuated state as illustrated in FIG. 3, whereby elastic column 45 is sufficiently compressed to become electrically conducting forming a localized conductive path through the thickness of the laminate interposer structure 22 electrically interconnecting contact 111 of device 110 to contact 121 of board 120.

According to the principle of the invention, the structure of laminate interposer structure 22 reduces the amount of contact force that is required to be applied to contact surfaces 46 and 47 of elastic columns 45 in order to form the conductive pathways through elastic columns 45 electrically interconnecting device 110 to board 120 in an actuation, and dramatically increases the expected life of contact set 21 and laminate interposer structure 22 compared to conventional compliant interconnect systems known in the art, which is principally due to the provision of intermediate layer 42 formed in laminate interposer structure 22. In particular, upper elastomer layer 40 provides compliance along x-y plane A between upper elastomer layer 40 and the length of elastic column 45 extending through hole 43A on the upper side of intermediate layer 42. Lower elastomer layer 41, in turn, provides compliance along x-y plane B between lower elastomer layer 41 and the length of elastic column 45 extending through hole 43B on the lower side of intermediate layer 42. However, intermediate layer 42 provides rigidity or otherwise inhibited or reduced compliance along x-y plane C between the intermediate length of elastic column 45 extending through hole 43C and continuous inner edge 80 of intermediate layer 42 concurrently encircling hole 43C and the intermediate length of elastic column 45 extending through hole 43C. In other words, the provision of intermediate layer 42 provides rigidity or reduced or otherwise inhibited compliance at the interface of the intermediate length of elastic column 45 through hole 43C and intermediate layer 42 between, and relative to, the compliance at the interface of elastomer layers 40 and 41 and the corresponding lengths of elastic column 45 extending through holes 43A and 43B on either side of the intermediate length of elastic column 45 extending through hole 43C. As a result, in response to the compressing of elastic column 45 at upper end lower ends 45A and 45B thereof by and between contact surface 35 of conductive contact 31 at upper end 45A and contact 121 of board 120 at lower end 45B in an actuation, the portion of elastic column at hole 43A through elastomer layer 40 displaces outwardly along x-y plane A into elastomer layer 40 outwardly displacing elastomer layer 40 relative to continuous inner edge 80 of intermediate layer 41, and the portion of elastic column at hole 43B through elastomer layer 41 displaces outwardly along x-y place B into elastomer layer 41 outwardly displacing elastomer layer 41 relative to continuous inner edge 80 of intermediate layer 41, as illustrated in FIG. 3. Because intermediate layer 42 is substantially rigid along x-y plane C coplanar relative to x-y planes A and B of upper and lower elastomer layers 40 and 41, compliance between intermediate layer 42 and elastic column 45 at hole 43C along x-y plane C is reduced, inhibited, or otherwise prevented relative to the compliance between upper and lower elastomer layers 40 and 41 and elastic column 45 along x-y planes A and B. As such, intermediate layer 42 prevents or otherwise inhibits elastic column 45 at bore 43C from displacing outwardly along x-y plane C at the interface between continuous inner edge 80 of intermediate layer and the confronting intermediate length of elastic column 45 extending through hole 43C, in accordance with the principle of the invention.

The described rigidity or reduced or inhibited compliance between the length of elastic column 45 extending through hole 43C and continuous inner edge 80 of intermediate layer 42 imparts rigidity to elastic column 45 at the intermediate length of elastic column 45 extending through hole 43C relative to and between lengths of elastic column 45 extending through holes 43A and 43B, respectively. This imparted rigidity in the intermediate length of elastic column 45 relative to the relative compliance provided between upper and lower elastomer layers 40 and 41 and the corresponding upper and lower lengths of elastic column 45 on either side of the intermediate length of elastic column 45 unexpectedly and surprisingly reduces the amount of z-axis compressive force required to be applied to elastic column 45 at upper end lower ends 45A and 45B thereof to produce the required conductive pathway through elastic column, and dramatically extends the service life of compliant interconnect assembly 90 by nearly four times compared to comparable compliant interconnect assemblies having comparable operating tolerances and parameters utilizing compliant elastomeric interposers formed without intermediate layer 42 according to the invention. The provision of intermediate layer 42 dramatically increases the operating life of elastic column 45, dramatically reduces the thickness of laminate interposer structure 22 compared to prior art interposers, and provides self-stopping limiting z-axis travel thereby resisting excessive squishing of elastic column 45. The service life of compliant interconnect assembly 90 is increased also because intermediate layer 42 imparts rigidity in laminate interposer structure 22 along x-y place C between elastomer layers 40 and 41, according to the principle of the invention.

Spacer 23 interacts between the lower or underside of device 110 facing contact set 21 and the opposing top or upper side of sheet 30 of contact set 21 concurrently permitting intimate contact between asperities 36 formed on contact surface 34 of conductive contact 31 and contact 111, and also limiting or otherwise governing the downward movement of contact surface 35 of tail 33A of conductive contact 31 into and against the contact surface formed in upper end 45A of elastic column 45 thereby limiting or otherwise governing the amount of z-axis compressive force that may be applied to elastic column 45 at upper and lower ends 45A and 45B thereof by contact surface 35 of conductive contact 31 and contact 121 of board 120, in accordance with the principle of the invention. The thickness of sheet 100 forming spacer 23 can, of course, be varied for varying the amount of z-axis compression applied to elastic column 45. The thicker the thickness of spacer 23 the less compressive force is obtained, and the thinner the thickness of spacer 23 the greater compressive force is obtained. Spacer 23 can be omitted, if desired, and compression mechanically controlled in other ways well-known in the art.

The arrangement of electronic device 110, contact set 21, laminate interposer structure 22, and board 120, allows convenient passage of current between the device 110 and board 120. This type of interconnection benefits from the reduced force needed to produce the conductive pathway through elastic columns 45 and provide reliable connection between devices compared with previous interconnection schemes. Connection force reduction relies upon attributes associated with laminate interposer structure 22, in accordance with the principle of the invention.

The sharpness of the asperities 36 assures essentially instant, current conducting electrical contact without concern to the surface condition of contact 111. Therefore, little force need be applied to connect contact 111 to conductive contact 31. On the other side of sheet 30, the shape of tail 33B and contact surface 35 of conductive contact 31 provides for efficient interaction with the contact surface formed in upper end 45A of elastic column 45 of laminate interpose structure 22. Tail 33B and contact surface 35 are together slightly smaller in area than the contact surface formed in upper end 45A of elastic column 45. This causes the contact surface formed in upper end 45A of elastic column 45 to wrap around contact surface 35 and tail 33B of conductive contact 31 with pressure applied at the interface there between. This "wrap-around" effect benefits by the elastic column 28 projecting from outer surface 50 of elastomer layer 40. This compliant projection forming upper end 45A of elastic column 45, not being confined by laminate interposer structure 22, is somewhat more flexible than the length of elastic column 45 encircled by elastomer layer 40. Added flexibility provides more ready conformability of the compliant projection forming upper end 45A to tail 33B of conductive contact 31 with resultant reduction in the connection force. Similarly the compliant projection associated with lower end 45B of elastic column 45 protruding outwardly from outer surface 60 of elastomer layer 41 allows slight spreading and thereby slightly increased area of contact between the contact face formed in lower end 45B of elastic column 45 and contact 121 of board 120.

It is to be understood that after completion of the actuation of compliant interconnect assembly 90 electrically interconnecting device 110 to board 120 as illustrated in FIG. 3, the compressive force applied between device 110 and board 120 is released, in which the elastic characteristic of elastomer layers 40 and 41 and elastomer column 45 cause elastomer layers 40 and 41 and elastic column 45 to assume their original or resting state as in FIG. 2 in preparation for a subsequent actuation. According to the principle of the invention, a compliant interconnect assembly 90 utilizing laminate interposer structure 22 constructed and arranged in accordance with the principle of the invention has, and quite amazingly, a service life of approximately four times that of comparable prior art compliant interconnect assemblies utilizing elastomeric interposers lacking intermediate layer 42 in accordance with the principle of the invention.

In a particular embodiment, the sheet forming intermediate layer 42 is formed of electrically-insulating, or electrically non-conductive, material. Preferably the sheet forming intermediate layer 42 is formed of polyimide material, such as the type found under the trademark Kapton. If desired, the sheet forming intermediate layer 42 can be formed of conductive material, or incorporate conductive traces or plating such that continuous edge 80 formed in intermediate layer 42 electrically contacts intermediate portion or thickness of the outer diameter of the corresponding elastic column 45 between the opposed upper and lower ends 45A and 45B thereof and, moreover, between elastomer layers 40 and 41. The sheet forming intermediate layer 42 can, in turn, be electrically connected to a test device or other electronic device for test and diagnostic purposes or other beneficial purpose, in accordance with the principle of the invention.

Figure 5:
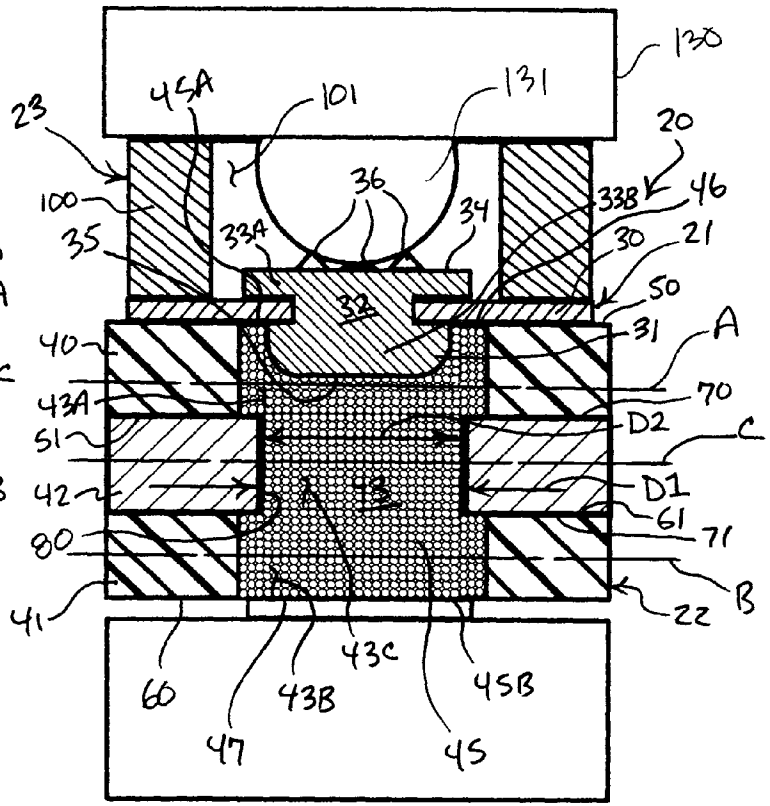
FIG. 5 is a view very similar to that of FIG. 4 illustrating the first alternate embodiment of a compliant interconnect assembly shown in an actuated state.
Figure 4:
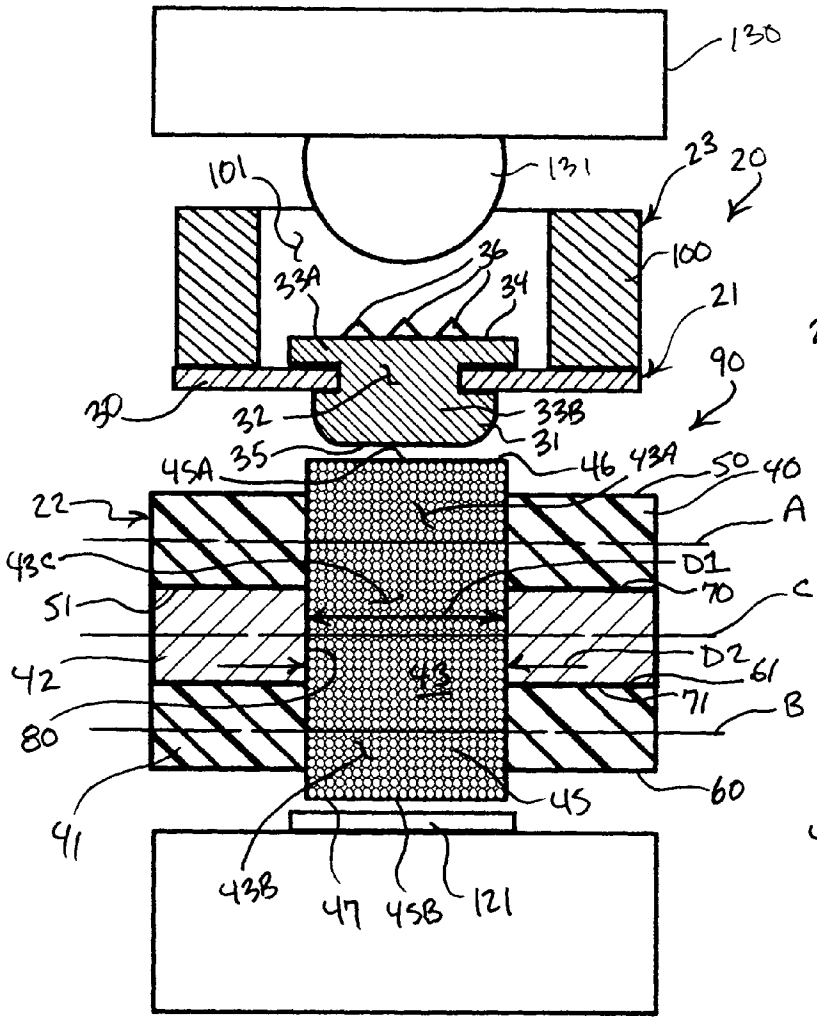
FIG. 4 is a cross sectional view illustrating a first alternate embodiment of a compliant interconnect assembly shown in a resting state.

The discussion of compliant interconnect apparatus 20 is discussed above in connection with device 110 including a pattern of planar electrical contacts 111. A compliant interconnect apparatus 20 constructed and arranged in accordance with the principle of the invention can, if desired, be used with equally-impressive results with electronic devices including ball grid arrays. As a matter of example, FIGS. 4 and 5 are cross sectional views very similar to FIGS. 3 and 4, respectively, which illustrate compliant interconnect assembly 90 as it would appear utilized in connection with an electronic device 130 having a ball electrical contact 131 forming part of a ball grid array (BGA) of device 130. In FIGS. 4 and 5, compliant interconnect assembly 90 is illustrated including laminate interposer structure 22 and an elastic column 45 and the corresponding conductive contact 31 of contact set 21. In this embodiment, spacer 23 disposed atop contact set 21 is substantially thicker compared to the thickness of spacer 23 illustrated in FIGS. 3 and 4 in order to accommodate the distance ball electrical contact 131 extends from device 130 such that in an actuation ball electrical contact 131 makes intimate electrical contact with asperities 36 formed in head 33A of conductive contact 31 and a desired compressive force applied to elastic column 45 is achieved.

FIG. 4 illustrates compliant interconnect assembly 90 shown at rest or otherwise in a resting state in conjunction with device 130, and FIG. 5 illustrates compliant interconnect assembly 90 of FIG. 4 shown actuated or otherwise in an actuated state in conjunction with device 130. In the resting state as shown in FIG. 4, device 130 is positioned atop spacer 23 located atop contact set 21 that is in turn located atop laminate interposer structure 22 overlying board 120. Spacer 23 is superimposed atop and rests against the upper side of contact set 21, and is positioned such that head 33A of conductive contact 31 supporting asperities 36 protruding from the upper side sheet 30 is received in hole 101 as illustrated, and asperities 36 are positioned in hole 101 well inboard of the upper side of spacer 23 confronting device 130 as clearly illustrated. Ball electrical contact 131 of device 110 extends into hole 101 from the upper side of spacer 23 and opposes, is registered with, and is spaced from asperities 36 formed in contact surface 34. Contact set 21 is, in turn, superimposed atop laminate interposer structure 22, whereby contact surface 35 of tail 33B of conductive contact 31 opposes, is registered with, and is spaced from contact surface 46 formed in upper end 45A of elastic column 45. Laminate interposer structure 22 is, in turn, superimposed atop board 120, whereby contact surface 47 formed in lower end 45B of elastic column 45 opposes, is registered with, and is spaced from contact 121 of board 120.

To form the interconnection between contacts 131 and 121 as illustrated in FIG. 5, an actuation is carried out. To carry out an actuation, device 130, spacer 23, contact set 21, laminate interposer structure 22, and board 120 are initially brought together, in which ball electrical contact 131 of device 110 makes electrical contact with asperities 36 formed in contact surface 34 of conductive contact 31, contact surface 35 formed in tail 33B of conductive contact 31 makes electrical contact with contact surface 46 formed in upper end 45A of elastic column 45, and contact surface 47 formed in lower end 45B of elastic column 45 makes electrical contact with contact 121 of board 120. Asperities 36 formed in contact surface 34 of conductive contact 31 extending upwardly toward ball electrical contact 131 make reliable contact with ball electrical contact 131 penetrating or abrading or otherwise disrupting any oxide covering that may have formed on ball electrical contact 131. At this point, compression is applied between device 110 and board 120 to complete the actuation compressing compliant interconnect assembly 90 therebetween driving tail 33B into upper end 45A of elastic column 45 compressing elastic column 45 along the z-axis or longitudinal axis of elastic column 45 at upper and lower ends 45A and 45B thereof between contact surface 35 of conductive contact 31 and contact 121 of board 120. In response to this z-axis compressing of elastic column 45 at contact surfaces 46 and 47 at upper and lower ends 45A and 45B thereof between contact surface 35 formed in tail 33B of conductive contact 31 and contact 121 of board 120, compliant interconnect assembly 90 is actuated or otherwise disposed in the actuated state as illustrated in FIG. 3, whereby elastic column 45 is sufficiently compressed to become electrically conducting forming a localized conductive path through the thickness of the laminate interposer structure 22 electrically interconnecting ball electrical contact 131 of device 110 to contact 121 of board 120. The operation and function of laminate interposer structure 22 is as discussed in connection with FIGS. 1-3.

Figure 7:
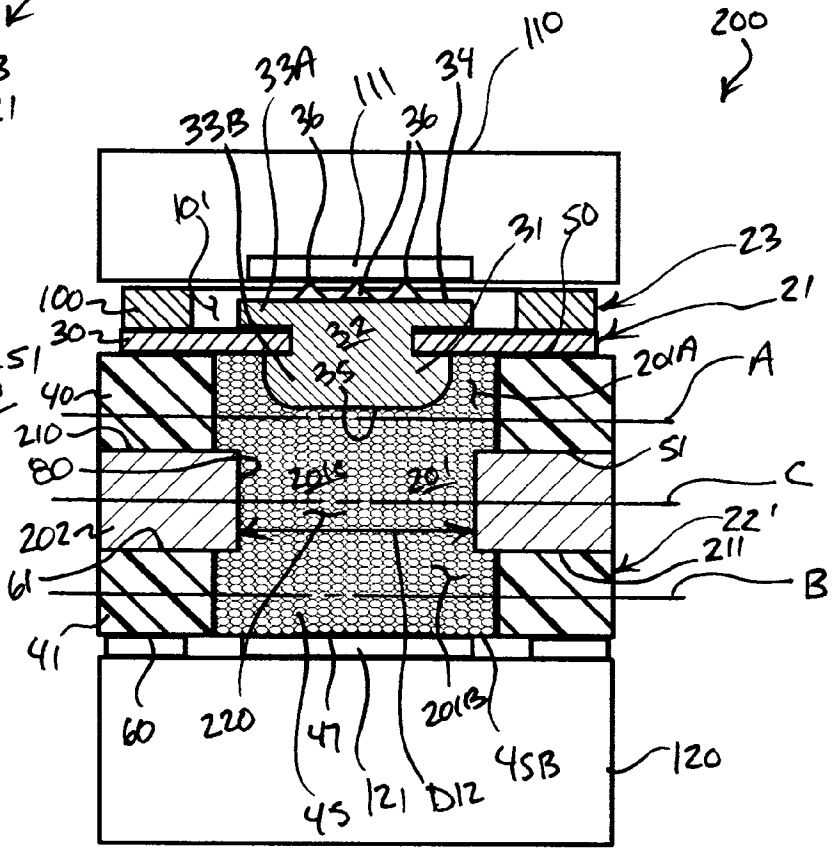
FIG. 7 is a view very similar to that of FIG. 6 illustrating the second alternate embodiment of a compliant interconnect assembly shown in an actuated state.
Figure 6:
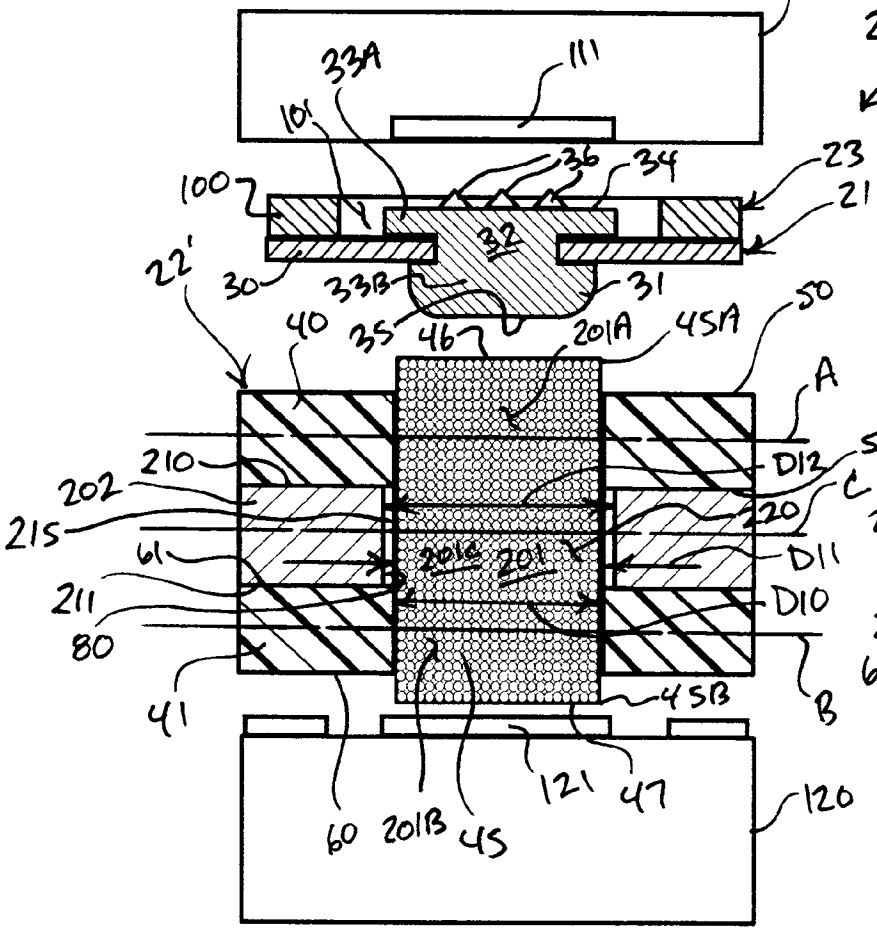
FIG. 6 is a cross sectional view illustrating a second alternate embodiment of a compliant interconnect assembly shown in a resting state.

Reference is now made to FIGS. 6 and 7, which illustrate an alternate embodiment of a compliant interconnect assembly 200 for utilization in a compliant interconnect apparatus constructed and arranged in accordance with the principle of the invention. Compliant interconnect assembly 200 in FIGS. 6 and 7 replaces each compliant interconnect assembly 90 formed in compliant interconnect apparatus 20 discussed in conjunction with FIGS. 1-5. FIG. 6 is a cross sectional view illustrating compliant interconnect assembly 200 shown at rest or otherwise in a resting state, and FIG. 7 is a view very similar to that of FIG. 6 illustrating compliant interconnect assembly shown actuated or otherwise in an actuated state. In common with compliant contact assembly 90, compliant contact assembly 200 shares contact set 21, laminate interposer structure 22, and also spacer 23 in this specific example, and is used to provide electrical interconnection between contact 111 of device 110 and contact 121 of board 120. According to the principle of the invention, laminate interposer structure 22 in connection with compliant contact assembly 200 is somewhat modified, as will now be discussed. For ease of reference, laminate interposer structure in FIGS. 6 and 7 is denoted at 22', and structure features of compliant interconnect assembly 200 common to compliant interconnect assembly 90 are reference with the same reference characters used to describe compliant interconnect assembly 90.

Referencing FIG. 6, laminate interposer structure 22' includes opposed upper and lower elastomer films or layers 40 and 41 formed on either side of intermediate film or layer 202 together forming laminate interposer structure 22' having a thickness. Referencing the structure of compliant interconnect assembly 200 according to the present embodiment, a bore, via, or hole 201 is formed, such as by drilling, through the thickness of laminate interposer structure 22'. Electrically conducting elastic column 45 is formed in hole 201 through the thickness of laminate interposer structure. Elastic column 45 juts out slightly beyond the opposite upper and lower surfaces or faces of laminate interposer structure 22'.

Elastic column 45 provides a localized conductive path through the thickness of the laminate interposer structure 22'. Upper and lower elastomer layers 40 and 41 provide compliance between upper and lower elastomer layers 40 and 41 and each of the elastic column 45 on either side of intermediate layer 202, in accordance with the principle of the invention. According to the principle of the invention, intermediate layer 202 provides rigidity or otherwise inhibited compliance between intermediate layer 202 and elastic columns 45 relative to the compliance between the upper and lower elastomer layers 40 and 41 and elastic column 45.

Elastomer layers 40 and 41 are formed of silicone elastomer or other selected elastomer material, and are of substantially uniform thickness. Elastomer layer 40 resides in and is compliant along x-y plane A, and elastomer layer 41 resides in and is compliant along x-y plane B. Planes A and B are coplanar, and are substantially perpendicular relative to elastic column 45. Intermediate layer 202 is a sheet of material, which is substantially rigid along an x-y plane C coplanar relative to the upper and lower elastomer layers 40 and 41 including x-y planes A and B, and substantially perpendicular relative to elastic columns 45. Elastic column 45 has an elongate shape disposed along a longitudinal axis substantially perpendicular relative to the laminate interposer structure, including elastomer layers 40 and 41 and intermediate layer 202 and also planes A, B, and C.

As with compliant interconnect assembly 90, elastomer layer 40 has as thickness and opposed, parallel outer and inner faces or surfaces 50 and 51, and elastomer layer 41 has a thickness and opposed, parallel outer and inner faces or surfaces 60 and 61. Intermediate layer 202 has a thickness and opposed, parallel upper and lower faces or surfaces 210 and 211. Elastomer layers 40 and 41 are formed, such as by molding, onto upper and lower surfaces 210 and 211, respectively, of intermediate layer 202. Inner surface 51 of elastomer layer 40 is applied to upper surface 210 of intermediate layer, and inner surface 61 of elastomer layer 41 is applied to lower surface 211 of intermediate layer 202. Hole 201 extends through the thickness of laminate interposer from outer surface 50 of elastomer layer 40 to outer surface 60 of elastomer layer 41. Hole 201 has an inner diameter, which is substantially constant from outer surface 50 of elastomer layer 40 to outer surface 60 of elastomer layer 41. Hole 201 forms a hole 201A through elastomer layer 40, a hole 201B through elastomer layer 41, and a hole 201C through intermediate layer 202. Holes 201A-201C are substantially equal in size and inner diameter and are coaxial.

Elastic column 45 has an outer diameter formed in the inner diameter of hole 201 between outer surfaces 50 and 60 of elastomer layers 40 and 41 of laminate interposer structure 22', and juts out slightly beyond the opposite outer surfaces 50 and 60 of elastomer layers 40 and 41 of laminate interposer structure 22'. The end of elastic column 45 jutting out slightly beyond outer surface 50 of elastic column 40 is upper end 45A, and the end of elastic column 45 jutting out slightly beyond outer surface 60 of elastomer layer 41 is lower end 45B. Upper and lower ends 45A and 45B of elastic column 45 are formed with opposed upper and lower contact surfaces 46 and 47, respectively.

Hole 201C formed through intermediate layer 202 within which elastic column 45 is formed is encircled by inwardly-directed continuous edge 80 formed in intermediate layer 202, but there is a continuous gap or void 215 encircling and formed between inwardly-directed continuous edge 80 and the outer diameter of elastic column 45.

Intermediate layer 202 is formed with a hole 220, and in the formation of laminate interposer structure 22' upper and lower elastomer layers 40 and 41 are then formed on either side of intermediate layer 202 together forming laminate interposer structure 22' having a thickness. In forming elastomer layers 40 and 41 on intermediate layer 202, hole 220 through the thickness of intermediate layer 202 is filled with elastomer material. To form hole 201, two spacer layers of protective tape are applied to outer surfaces 50 and 51, respectively, of elastomer layers 40 and 41. A drilling sequence is carried out forming hole 201 through the thickness of laminate interposer structure 22', which hole 201 extends through, and is coaxial with, hole 220. However, the inner diameter of hole 220 is greater than the inner diameter of hole 201 thereby forming continuous void 215 encircling the intermediate length of hole 201. Fluid conductive silicone is applied to hole 201, which is left to cure to form elastic columns 45 in hole 201. A typical conductive silicone fluid is used, which consists of a curable silicone composition containing conductive particles, such as particulate metals such as copper, nickel, silver coated metals, and conductive carbon particulates and the like. After curing of the conductive silicone forming elastic column 45, excess conductive silicone is removed by, for instance, shaving away the excess conductive silicone. A spacer layer of protective tape is removed from each of the outer surfaces 50 and 51 of elastomer layers 40 and 41, which reveal tips of the electrically conductive elastic columns, which are sized according to the column diameters and thickness of the spacer layers of protective tape. The possibility that some of the column or ends tips may have contact surface irregularities can require the need for a second shaving step, against the smooth surface of second spacer layers applied to outer surfaces 50 and 60, respectively, of elastomer layers 40 and 41, until there is coplanarity of the surface of each of the spacer layers with the tips of the elastic columns 45 forming the opposed upper and lower contact surfaces of the elastic columns 45 having exposed particles. After removing the remaining spacer layers of protective tape from outer surfaces 50 and 60 of elastomer layers 40 and 41, rows of compliant projections having exposed particles at upper and lower contact surfaces thereof appear at outer surfaces 50 and 60 of elastomer layers 40 and 41, this time with essentially uniform coplanar contact surfaces, comprising contact surfaces 46 and 47 in upper and lower ends 45A and 45B of elastic columns 45, to allow reliable contact between electronic devices via electrically conducting elastic columns. Before use, the formed laminate interposer structure 22' requires cleaning to remove surface contamination and debris. Thus formed, laminate interposer structure 22' has attributes including precise construction, flexibility, high resilience, high durability, and low profile.

Laminate interposer structure 22' and elastic column 45 and the corresponding conductive contact 31 of contact set 21 constitutes compliant interconnect assembly 200. For reference purposes as denoted in FIG. 2, the inner diameter of hole 201 is denoted at D10, the outer diameter of elastic column 45 is denoted at D11, and the inner diameter of hole 220 is denoted at D12, in which inner diameter D12 of hole 220 is larger than inner diameter D10 of hole encircling and contacting an intermediate length of outer diameter D11 of elastic column 45 forming continuous void 215.

Compliant interconnect assembly 200 provides low contact force interconnection between electronic devices, which, in FIG. 6, include electronic device 110 formed with planar electrical contact 111, and board 120. The connection point on board 120 takes the form of planar electrical contact 121. Interconnection of device 110 to board 120 utilizes compliant interconnect assembly 200 according to the present invention. Contact set 21 makes contact between contact 111 of device 110 and the upper contact face 46 formed in upper end 45A of elastic column 45 of laminate interposer structure 22', and lower contact face 47 formed in lower end 45B of elastic column 45 of laminate interposer structure 22' makes contact with contact 121 of board 120.

In FIG. 6, device 110 is positioned atop spacer 23 located atop contact set 21 that is in turn located atop laminate interposer structure 22' overlying board 120. Spacer 23 is superimposed atop and rests against the upper side of contact set 21, and is positioned such that head 33A of conductive contact 31 supporting asperities 36 protruding from the upper side sheet 30 is received in hole 101 as illustrated, and asperities 36 extend somewhat upwardly relative to the upper side of spacer 23 confronting device 110 as clearly illustrated. Contact 111 of device 110 opposes, is registered with, and is spaced from asperities 36 formed in contact surface 34. Contact set 21 is, in turn, superimposed atop laminate interposer structure 22', whereby contact surface 35 of tail 33B of conductive contact 31 opposes, is registered with, and is spaced from contact surface 46 formed in upper end 45A of elastic column 45. Laminate interposer structure 22' is, in turn, superimposed atop board 120, whereby contact surface 47 formed in lower end 45B of elastic column 45 opposes, is registered with, and is spaced from contact 121 of board 120.

To form the interconnection between contacts 111 and 121 as illustrated in FIG. 7, an actuation is carried out. To carry out an actuation, device 110, spacer 23, contact set 21, laminate interposer structure 22', and board 120 are initially brought together, in which contact 111 of device 110 makes electrical contact with asperities 36 formed in contact surface 34 of conductive contact 31, contact surface 35 formed in tail 33B of conductive contact 31 makes electrical contact with contact surface 46 formed in upper end 45A of elastic column 45, and contact surface 47 formed in lower end 45B of elastic column 45 makes electrical contact with contact 121 of board 120. Asperities 36 formed in contact surface 34 of conductive contact 31 extending upwardly toward contact 111 relative to the upper side of spacer 23 make reliable contact with contact 111 penetrating or abrading or otherwise disrupting any oxide covering that may have formed on contact 111.

At this point, compression is applied between device 110 and board 120 to complete the actuation compressing compliant interconnect assembly 200 therebetween driving tail 33B into upper end 45A of elastic column 45 compressing elastic column 45 along the z-axis or longitudinal axis of elastic column 45 at upper and lower ends 45A and 45B thereof between contact surface 35 of conductive contact 31 and contact 121 of board 120. In response to this z-axis compressing of elastic column 45 at contact surfaces 46 and 47 at upper and lower ends 45A and 45B thereof between contact surface 35 formed in tail 33B of conductive contact 31 and contact 121 of board 120, compliant interconnect assembly 200 is actuated or otherwise disposed in the actuated state as illustrated in FIG. 7, whereby elastic column 45 is sufficiently compressed to become electrically conducting forming a localized conductive path through the thickness of the laminate interposer structure 22' electrically interconnecting contact 111 of device 110 to contact 121 of board 120.

According to the principle of the invention, the structure of laminate interposer structure 22' reduces the amount of contact force that is required to be applied to contact surfaces 46 and 47 of elastic column 45 in order to form the conductive pathway through elastic columns 45 electrically interconnecting device 110 to board 120 in an actuation, and dramatically increases the expected life of contact set 21 and laminate interposer structure 22' compared to conventional compliant interconnect systems known in the art, which is principally due to the provision of intermediate layer 202 formed in laminate interposer structure 22'. In particular, upper elastomer layer 40 provides compliance along x-y plane A between upper elastomer layer 40 and the length of elastic column 45 extending through hole 201A on the upper side of intermediate layer 202. Lower elastomer layer 41, in turn, provides compliance along x-y plane B between lower elastomer layer 41 and the length of elastic column 45 extending through hole 201B on the lower side of intermediate layer 202. However, intermediate layer 202 provides reduced compliance along x-y plane C between the intermediate length of elastic column 45 extending through hole 201C and continuous inner edge 80 of intermediate layer 202 concurrently encircling hole 201C and the intermediate length of elastic column 45 extending through hole 201C relative to the compliance provided between elastomer layers 40 and 41 of elastic column 45.

In other words, the provision of intermediate layer 202 provides rigidity or reduced or otherwise inhibited compliance between intermediate length of elastic column 45 through hole 201C and intermediate layer 202 between, and relative to, the compliance at the interface of elastomer layers 40 and 41 and the corresponding lengths of elastic column 45 extending through holes 201A and 201B on either side of the intermediate length of elastic column 45 extending through hole 201C. As a result, in response to the compressing of elastic column 45 at upper end lower ends 45A and 45B thereof by and between contact surface 35 of conductive contact 31 at upper end 45A and contact 121 of board 120 at lower end 45B in an actuation, the portion or length of elastic column at hole 201A through elastomer layer 40 displaces outwardly along x-y plane A into elastomer layer 40 outwardly displacing elastomer layer 40, and the portion or length of elastic column at hole 201B through elastomer layer 41 displaces outwardly along x-y place B into elastomer layer 41 outwardly displacing elastomer layer 41 relative to continuous inner edge 80 of intermediate layer 41, as illustrated in FIG. 3. Because intermediate layer 202 is substantially rigid along x-y plane C coplanar relative to x-y planes A and B of upper and lower elastomer layers 40 and 41, compliance between intermediate layer 202 and elastic column 45 at hole 201C along x-y plane C is reduced, inhibited, or otherwise prevented relative to relative to the compliance between upper and lower elastomer layers 40 and 41 and elastic column 45 along x-y planes A and B. As such, intermediate layer 202 prevents or otherwise inhibits elastic column 45 at hole 201C from displacing outwardly along x-y plane C beyond continuous inner edge 80. In response to compression of elastic column, the intermediate portion of elastic column 45 at bore 201C separated or otherwise spaced apart from continuous inner edge 80 by void 215 initially displaces outwardly into void 215 bringing the outer diameter of the intermediate portion of elastic column 45 in contact with continuous inner edge 80. At this point, however, the intermediate portion of elastic column 45 at hole 201C is prevented by the x-y rigidity of intermediate layer 202 from displacing outwardly along x-y place C beyond continuous inner edge 80, which imparts the beneficial rigidity to the intermediate length of elastic column 45 at hole 201C. Moreover, the proximity of continuous inner edge 80 relative to the confronting intermediate length of elastic column 45 at hole 201C inherently provides inhibited compliance between the intermediate length of elastic column 45 at hole 201C and intermediate layer 202 along x-y place C relative to the compliance between the upper and lower lengths of elastic column extending through holes 201A and 201B and upper and lower elastomer layers 40 and 41 along x-y planes A and B, respectively, in accordance with the principle of the invention.

The described rigidity or reduced or inhibited compliance between the length of elastic column 45 extending through hole 201C and continuous inner edge 80 of intermediate layer 202 imparts rigidity to elastic column 45 at the intermediate length of elastic column 45 extending through hole 201C relative to and between lengths of elastic column 45 extending through holes 201A and 201B, respectively. This imparted rigidity in the intermediate length of elastic column 45 relative to the relative compliance provided between upper and lower elastomer layers 40 and 41 and the corresponding upper and lower lengths of elastic column 45 on either side of the intermediate length of elastic column 45 unexpectedly and surprisingly reduces the amount of z-axis compressive force required to be applied to elastic column 45 at upper end lower ends 45A and 45B thereof to produce the required conductive pathway through elastic column, and dramatically extends the service life of compliant interconnect assembly 200 by nearly four times compared to comparable compliant interconnect assemblies having comparable operating tolerances and parameters utilizing compliant elastomeric interposers formed without intermediate layer 42 according to the invention. The provision of intermediate layer 42 dramatically increases the operating life of elastic column 45, dramatically reduces the thickness of laminate interposer structure 22' compared to prior art interposers, and provides self-stopping limiting z-axis travel thereby resisting excessive squishing of elastic column 45. The service life of compliant interconnect assembly 200 is increased also because intermediate layer 42 imparts rigidity in laminate interposer structure 22' along x-y place C between elastomer layers 40 and 41, according to the principle of the invention.

Spacer 23 interacts between the lower or underside of device 110 facing contact set 21 and the opposing top or upper side of sheet 30 of contact set 21 concurrently permitting intimate contact between asperities 36 formed on contact surface 34 of conductive contact 31 and contact 111, and also limiting or otherwise governing the downward movement of contact surface 35 of tail 33A of conductive contact 31 into and against the contact surface formed in upper end 45A of elastic column 45 thereby limiting or otherwise governing the amount of z-axis compressive force that may be applied to elastic column 45 at upper and lower ends 45A and 45B thereof by contact surface 35 of conductive contact 31 and contact 121 of board 120, in accordance with the principle of the invention. The thickness of sheet 100 forming spacer 23 can, of course, be varied for varying the amount of z-axis compression applied to elastic column 45. The thicker the thickness of spacer 23 the less compressive force is obtained, and the thinner the thickness of spacer 23 the greater compressive force is obtained. Spacer 23 can be omitted, if desired, and compression mechanically controlled in other ways well-known in the art.

The arrangement of electronic device 110, contact set 21, laminate interposer structure 22', and board 120, allows convenient passage of current between the device 110 and board 120. This type of interconnection benefits from the reduced force needed to produce the conductive pathway through elastic columns 45 and provide reliable connection between devices compared with previous interconnection schemes. Connection force reduction relies upon attributes associated with laminate interposer structure 22', in accordance with the principle of the invention.

The sharpness of the asperities 36 assures essentially instant, current conducting electrical contact without concern to the surface condition of contact 111. Therefore, little force need be applied to connect contact 111 to conductive contact 31. On the other side of sheet 30, the shape of tail 33B and contact surface 35 of conductive contact 31 provides for efficient interaction with the contact surface formed in upper end 45A of elastic column 45 of laminate interpose structure 22'. Tail 33B and contact surface 35 are together slightly smaller in area than the contact surface formed in upper end 45A of elastic column 45. This causes the contact surface formed in upper end 45A of elastic column 45 to wrap around contact surface 35 and tail 33B of conductive contact 31 with pressure applied at the interface there between. This "wrap-around" effect benefits by the elastic column 28 projecting from outer surface 50 of elastomer layer 40. This compliant projection forming upper end 45A of elastic column 45, not being confined by laminate interposer structure 22', is somewhat more flexible than the length of elastic column 45 encircled by elastomer layer 40. Added flexibility provides more ready conformability of the compliant projection forming upper end 45A to tail 33B of conductive contact 31 with resultant reduction in the connection force. Similarly the compliant projection associated with lower end 45B of elastic column 45 protruding outwardly from outer surface 60 of elastomer layer 41 allows slight spreading and thereby slightly increased area of contact between the contact face formed in lower end 45B of elastic column 45 and contact 121 of board 120.

It is to be understood that after completion of the actuation of compliant interconnect assembly 200 electrically interconnecting device 110 to board 120 as illustrated in FIG. 7, the compressive force applied between device 110 and board 120 is released, in which the elastic characteristic of elastomer layers 40 and 41 and elastomer column 45 cause elastomer layers 40 and 41 and elastic column 45 to assume their original or resting state as in FIG. 6 in preparation for a subsequent actuation. According to the principle of the invention, a compliant interconnect assembly 200 utilizing laminate interposer structure 202 constructed and arranged in accordance with the principle of the invention has, and quite amazingly, a service life of approximately four times that of comparable prior art compliant interconnect assemblies utilizing elastomeric interposers lacking intermediate layer 202 in accordance with the principle of the invention.

In a particular embodiment, the sheet forming intermediate layer 202 is formed of electrically-insulating, or electrically non-conductive, material. Preferably the sheet forming intermediate layer 202 is formed of polyimide material, such as the type found under the trademark Kapton.

In another embodiment according to the principle of the invention, the sheet forming intermediate layer 202 is formed of conductive material, or incorporates conductive traces or plating. In this embodiment, in an actuation of compliant contact assembly continuous edge 80 formed in intermediate layer 202 electrically contacts intermediate portion or thickness of the outer diameter of elastic column 45 between the opposed upper and lower ends 45A and 45B thereof and, moreover, between elastomer layers 40 and 41. The sheet forming intermediate layer 202 may, in turn, be electrically coupled to an auxiliary device for test purposes. The sheet forming intermediate layer 202 can, in turn, be electrically connected to a test device or other electronic device for test and diagnostic purposes or other beneficial purpose, in accordance with the principle of the invention.

Figure 9:
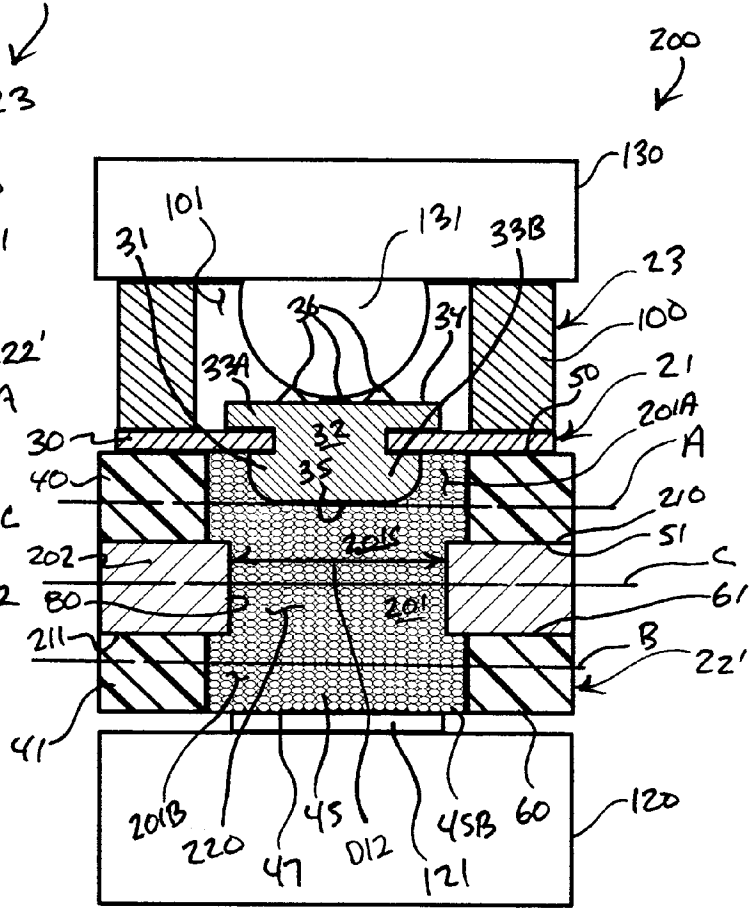
FIG. 9 is a view very similar to that of FIG. 6 illustrating the third alternate embodiment of a compliant interconnect assembly shown in an actuated state.
Figure 8:
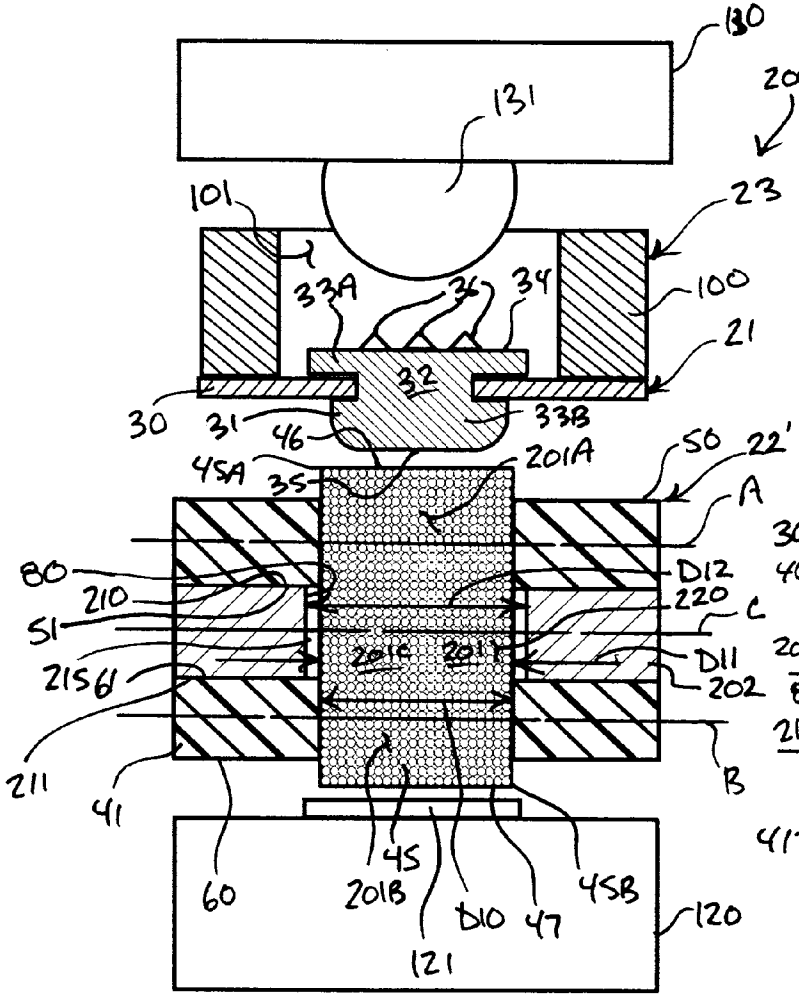
FIG. 8 is a cross sectional view illustrating a third alternate embodiment of a compliant interconnect assembly shown in a resting state.

The discussion of compliant interconnect assembly 200 is discussed above in connection with device 110 including a pattern of planar electrical contacts 111. A compliant interconnect assembly 200 constructed and arranged in accordance with the principle of the invention can, if desired, be used with equally-impressive results with electronic devices including ball grid arrays. As a matter of example, FIGS. 8 and 9 are cross sectional views very similar to FIGS. 6 and 7, respectively, which illustrate compliant interconnect assembly 200 as it would appear utilized in connection with electronic device 130 having ball electrical contact 131 forming part of the BGA of device 130. In FIGS. 8 and 9, compliant interconnect assembly 200 is illustrated including laminate interposer structure 22' and an elastic column 45 and the corresponding conductive contact 31 of contact set 21. In this embodiment, spacer 23 disposed atop contact set 21 is substantially thicker compared to the thickness of spacer 23 illustrated in FIGS. 6 and 7 in order to accommodate the distance ball electrical contact 131 extends from device 130 such that in an actuation ball electrical contact 131 makes intimate electrical contact with asperities 36 formed in head 33A of conductive contact 31 and a desired compressive force applied to elastic column 45 is achieved.

FIG. 8 illustrates compliant interconnect assembly 200 shown at rest or otherwise in a resting state in conjunction with device 130, and FIG. 9 illustrates compliant interconnect assembly 200 of FIG. 8 shown actuated or otherwise in an actuated state in conjunction with device 130. In the resting state as shown in FIG. 8, device 130 is positioned atop spacer 23 located atop contact set 21 that is in turn located atop laminate interposer structure 22' overlying board 120. Spacer 23 is superimposed atop and rests against the upper side of contact set 21, and is positioned such that head 33A of conductive contact 31 supporting asperities 36 protruding from the upper side sheet 30 is received in hole 101 as illustrated, and asperities 36 are positioned in hole 101 well inboard of the upper side of spacer 23 confronting device 130 as clearly illustrated. Ball electrical contact 131 of device 110 extends into hole 101 from the upper side of spacer 23 and opposes, is registered with, and is spaced from asperities 36 formed in contact surface 34. Contact set 21 is, in turn, superimposed atop laminate interposer structure 22', whereby contact surface 35 of tail 33B of conductive contact 31 opposes, is registered with, and is spaced from contact surface 46 formed in upper end 45A of elastic column 45. Laminate interposer structure 22' is, in turn, superimposed atop board 120, whereby contact surface 47 formed in lower end 45B of elastic column 45 opposes, is registered with, and is spaced from contact 121 of board 120.

To form the interconnection between contacts 131 and 121 as illustrated in FIG. 9, an actuation is carried out. To carry out an actuation, device 130, spacer 23, contact set 21, laminate interposer structure 22', and board 120 are initially brought together, in which ball electrical contact 131 of device 110 makes electrical contact with asperities 36 formed in contact surface 34 of conductive contact 31, contact surface 35 formed in tail 33B of conductive contact 31 makes electrical contact with contact surface 46 formed in upper end 45A of elastic column 45, and contact surface 47 formed in lower end 45B of elastic column 45 makes electrical contact with contact 121 of board 120. Asperities 36 formed in contact surface 34 of conductive contact 31 extending upwardly toward ball electrical contact 131 make reliable contact with ball electrical contact 131 penetrating or abrading or otherwise disrupting any oxide covering that may have formed on ball electrical contact 131. At this point, compression is applied between device 110 and board 120 to complete the actuation compressing compliant interconnect assembly 200 therebetween driving tail 33B into upper end 45A of elastic column 45 compressing elastic column 45 along the z-axis or longitudinal axis of elastic column 45 at upper and lower ends 45A and 45B thereof between contact surface 35 of conductive contact 31 and contact 121 of board 120. In response to this z-axis compressing of elastic column 45 at contact surfaces 46 and 47 at upper and lower ends 45A and 45B thereof between contact surface 35 formed in tail 33B of conductive contact 31 and contact 121 of board 120, compliant interconnect assembly 200 is actuated or otherwise disposed in the actuated state as illustrated in FIG. 3, whereby elastic column 45 is sufficiently compressed to become electrically conducting forming a localized conductive path through the thickness of the laminate interposer structure 22' electrically interconnecting ball electrical contact 131 of device 110 to contact 121 of board 120. The operation and function of laminate interposer structure 22' is as discussed in connection with FIGS. 6 and 7.

The present invention is described above with reference to preferred embodiments. However, those skilled in the art will recognize that changes and modifications may be made in the described embodiments without departing from the nature and scope of the present invention. Various changes and modifications to the embodiments herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. Apparatus to electrically connect a first electrical contact to a second electrical contact, comprising:

opposed upper and lower elastomer layers formed on either side of an intermediate layer together forming a laminate interposer structure having a thickness;

an electrically conducting elastic column to provide a localized conductive path through the thickness of the laminate interposer structure;

the upper and lower elastomer layers to provide compliance between the upper and lower elastomer layers and the elastic column;

the intermediate layer to provide inhibited compliance between the intermediate layer and the elastic column relative to the compliance between the upper and lower elastomer layers and the elastic column;

the intermediate layer comprises a sheet of material substantially rigid along a plane substantially perpendicular relative to the elastic column;

the elastic column has an elongate shape disposed along a longitudinal axis substantially perpendicular relative to the laminate interposer structure, including the plane; and the sheet is formed with an inwardly-directed continuous edge confronting and encircling an intermediate portion of the elastic column between the opposed upper and lower ends of the elastic column.

2. An apparatus to electrically connect a first electrical contact to a second electrical contact according to claim 1, wherein the inwardly-directed continuous edge contacts the elastic column.

3. An apparatus to electrically connect a first electrical contact to a second electrical contact according to claim 1, wherein the inwardly-directed continuous edge is spaced away from the elastic column.

4. An apparatus to electrically connect a first electrical contact to a second electrical contact according to claim 3, further comprising:

a void encircling and formed between the inwardly-directed continuous edge and the elastic column;

the sheet of material being electrically conductive; and the elastic column electrically contacting the inwardly-directed continuous edge in response to compression of the elastic column.

5. Apparatus to electrically connect a first electrical contact to a second electrical contact, comprising:

opposed upper and lower elastomer layers having opposed inner and outer faces, the inner faces of the opposed upper and lower elastomer layers formed on either side of an intermediate layer together forming a laminate interposer structure having a thickness;

an electrically conducting elastic column to provide a localized conductive path through the thickness of the laminate interposer structure between the outer faces of the opposed upper and lower elastomer layers;

the upper and lower elastomer layers to provide compliance between the upper and lower elastomer layers and the elastic column;

the intermediate layer to provide inhibited compliance between the intermediate layer and the elastic column relative to the compliance between the upper and lower elastomer layers and the elastic column;

a spacer, to regulate compression against the elastic column, positioned in juxtaposition relative to the outer face of one of the upper and lower elastomer layers;

the intermediate layer comprises a sheet of material substantially rigid along a plane substantially perpendicular relative to the elastic column;

the elastic column has an elongate shape disposed along a longitudinal axis substantially perpendicular relative to the laminate interposer structure, including the plane; and the sheet is formed with an inwardly-directed continuous edge confronting and encircling an intermediate portion of the elastic column between the opposed upper and lower ends of the elastic column.

6. An apparatus to electrically connect a first electrical contact to a second electrical contact according to claim 5, wherein the inwardly-directed continuous edge contacts the elastic column.

7. An apparatus to electrically connect a first electrical contact to a second electrical contact according to claim 6, wherein the inwardly-directed continuous edge is spaced away from the elastic column.

8. An apparatus to electrically connect a first electrical contact to a second electrical contact according to claim 7, further comprising:

a void encircling and formed between the inwardly-directed continuous edge and the elastic column;

the sheet of material being electrically conductive; and the elastic column electrically contacting the inwardly-directed continuous edge in response to compression of the elastic column.

* * * * *